US008991825B2

(12) United States Patent
Pockaj

(10) Patent No.: US 8,991,825 B2
(45) Date of Patent: Mar. 31, 2015

(54) BALL EJECTION SYSTEM AND METHOD FOR WHEEL GAMES

(71) Applicant: Pockaj D.O.O. (d.b.a. Alfastreet), Kozina (SI)

(72) Inventor: Iztok Pockaj, Lokev (SI)

(73) Assignee: Pockaj D.O.O. (SI)

( * ) Notice: Subject to any disclaimer, the term of this patent is extended or adjusted under 35 U.S.C. 154(b) by 0 days.

(21) Appl. No.: 14/293,873

(22) Filed: Jun. 2, 2014

(65) Prior Publication Data

US 2014/0353912 A1 Dec. 4, 2014

Related U.S. Application Data

(63) Continuation-in-part of application No. 14/171,542, filed on Feb. 3, 2014, and a continuation-in-part of application No. 14/120,329, filed on May 14, 2013.

(60) Provisional application No. 61/829,854, filed on May 13, 2013.

(51) Int. Cl.
*A63F 9/24* (2006.01)
*A63F 5/00* (2006.01)

(52) U.S. Cl.
CPC ..... *A63F 5/0082* (2013.01); *A63F 5/007* (2013.01); *A63F 5/0005* (2013.01)
USPC ..... 273/142 E; 463/17

(58) Field of Classification Search
CPC ..... A63F 5/0005; A63F 5/007
USPC ..... 463/17; 273/142 E
See application file for complete search history.

(56) References Cited

U.S. PATENT DOCUMENTS

| | | | | |
|---|---|---|---|---|
| 4,735,416 | A * | 4/1988 | McNally | 463/22 |
| 4,906,005 | A * | 3/1990 | Manabe | 463/22 |
| 4,989,873 | A * | 2/1991 | Manabe | 463/22 |
| 6,520,854 | B1 * | 2/2003 | McNally | 463/17 |
| 2006/0267274 | A1 * | 11/2006 | Cammegh | 273/138.1 |
| 2008/0139281 | A1 | 6/2008 | Yoshizawa | |
| 2009/0061981 | A1 | 3/2009 | Smith | |
| 2011/0001286 | A1 * | 1/2011 | Yokota | 273/142 E |
| 2011/0218027 | A1 | 9/2011 | Manz et al. | |

FOREIGN PATENT DOCUMENTS

| | | | | |
|---|---|---|---|---|
| SI | 23533 | * | 5/2012 | A63F 5/00 |

OTHER PUBLICATIONS

International Search Report and Written Opinion—Date of Mailing: Jun. 25, 2014.

* cited by examiner

*Primary Examiner* — Corbett B Coburn
(74) *Attorney, Agent, or Firm* — Newman Law, LLC

(57) ABSTRACT

A ball ejection system for a roulette game is provided. The system includes a roulette wheel including a plurality of slots, at least one sensor, at least one ejector element, and a first driving mechanism. Each slot is defined by side walls and a bottom surface. Each bottom surface further includes an opening. The at least one sensor is position within each of the plurality of slots and are configured to emit a signal when detecting a ball within the slot. The ejector element is positioned below the roulette and includes at least one air blower. The air blower is configured to blow air circumferentially around the roulette wheel due to the detection of a ball on one of the sensors. Finally, the first driving mechanism is in communication with the at least one ejector element and configured to cause the initiation of the at least one air blower.

10 Claims, 14 Drawing Sheets

BALL EJECTION SYSTEM AND METHOD FOR WHEEL GAMES

CROSS REFERENCE TO RELATED APPLICATIONS

This application claims priority to U.S. Provisional Application No. 61/829,854 entitled BALL EJECTION SYSTEM AND METHOD FOR WHEEL GAMES, filed on May 31, 2013, the entirety of which is incorporated herein by reference.

This application is a Continuation-in-Part of U.S. Non-Provisional application Ser. No. 14/171,542, Applicant Reference Number 061025.00011 entitled BINGO GAME SYSTEM WITH SPINNING WHEEL OUTCOME PRESENTING FEATURE, filed on Feb. 3, 2014, the entirety of which is incorporated herein by reference.

This application is a Continuation-in-Part of U.S. Non-Provisional application Ser. No. 14/120,329, Applicant Reference Number 061025.00013 entitled REMOTE GAMING TERMINAL AND PLAYER INTERFACE, filed on May 14, 2013, the entirety of which is incorporated herein by reference.

COPYRIGHT NOTICE

A portion of this disclosure contains material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

BACKGROUND

The invention is directed to wagering games, and more particularly, roulette games typically found in gaming establishments, such as those involving a roulette wheel, playing surface, playing positions for multiple players, playing cards, and a dealer, or virtual representations thereof.

Roulette is a well-known casino game which has been played for many years. A typical roulette game consists of a table with betting layout adjacent to a roulette wheel rotor or ring mounted for rotational motion within a support structure. The ring includes a circular array of numbered segments bearing numbers 1 through 36 defined on its upper surface. American Roulette wheels typically have rings which also include the numbers 0 and 00 disposed at diametrically opposite locations on the upper surface, whereas European Roulette wheels include only the number 0. The numbers 1 through 36 are not disposed in numerical order, but rather are typically disposed in a predetermined arrangement, such that roulette wheels located in different casinos will have the same standard predetermined number ring arrangement. The numbers disposed in a circular array in the number ring region of the wheel bear the alternating colors of red and black, with the exception of the 0 and/or 00 numbers, which are typically colored green. A ring of pockets corresponding in number to the plurality of numbers of the ring lies adjacent, but radially inward of the ring, on the typical roulette wheel. A typical roulette wheel further includes a circular, inclined ball track radially outward of the ring.

In operation of a typical roulette game, players place chips or tokens on a betting layout located on a roulette table, and then the croupier or dealer spins the roulette wheel and the roulette ball is placed in motion along the circular ball track in the opposite direction of the rotation of the wheel. As the wheel slows, the ball moves radially inward and comes to rest in one of the pockets associated with a particular one of the numbers of the number ring. After the ball comes to rest in one of the pockets, the croupier or dealer settles the various wagers placed on the table layout in accordance with predetermined rules and wager odds and the process is repeated.

Gaming establishments or casinos continually require new games to offer their players. Players are typically attracted to games that provide relatively decent odds of winning, as compared with other casino games, and can be played rapidly. It has been found that many of the games which have been successful also offer lively game play features that further serve to heighten player interest in such games. Naturally, casino operators seek to provide the most popular games for their gaming patrons.

Thus, there is a need for systems and methods which resolve one or more of the problems identified above, among other things.

SUMMARY OF INVENTION

The invention is generally directed to various embodiments of providing a roulette wheel system that allows for controlled ejection of a ball or controlled game illumination during game play.

Some embodiments of the invention are directed to a ball ejection system for a roulette game. The ball ejection system includes a roulette wheel including a plurality of slots, at least one sensor, at least one ejector element, and a first driving mechanism. Each slot is defined by side walls and a bottom surface. Each bottom surface further includes an opening. The at least one sensor is positioned within each of the plurality of slots and are configured to emit a signal when detecting a ball within the slot. The ejector element is positioned below the roulette and includes at least one air blower. The air blower is configured to blow air circumferentially around the roulette wheel in response to the detection of a ball on one of the sensors. Finally, the first driving mechanism is in communication with the at least one ejector element and configured to cause the initiation of the at least one air blower.

Some embodiments of the invention are directed to an illumination system for a roulette game. The illumination system includes a roulette wheel, a lighting pedestal, and a controller. The roulette wheel is mounted for rotational motion. The lighting pedestal is centrally mounted above the roulette wheel and also mounted for rotational motion. The lighting pedestal also includes at least one LED light holder and at least one LED light. The holder is mounted to the lighting pedestal and the at least one light is mounted to the holder. Finally, the controller is connected to the at least one LED light and configured to activate at least one LED light as a function of the rotation motion of the roulette wheel.

BRIEF DESCRIPTION OF THE DRAWINGS

Other advantages of the invention will be readily appreciated as the same becomes better understood by reference to the following detailed description when considered in connection with the accompanying drawings.

DETAILED DESCRIPTION OF INVENTION

Figure 1B:
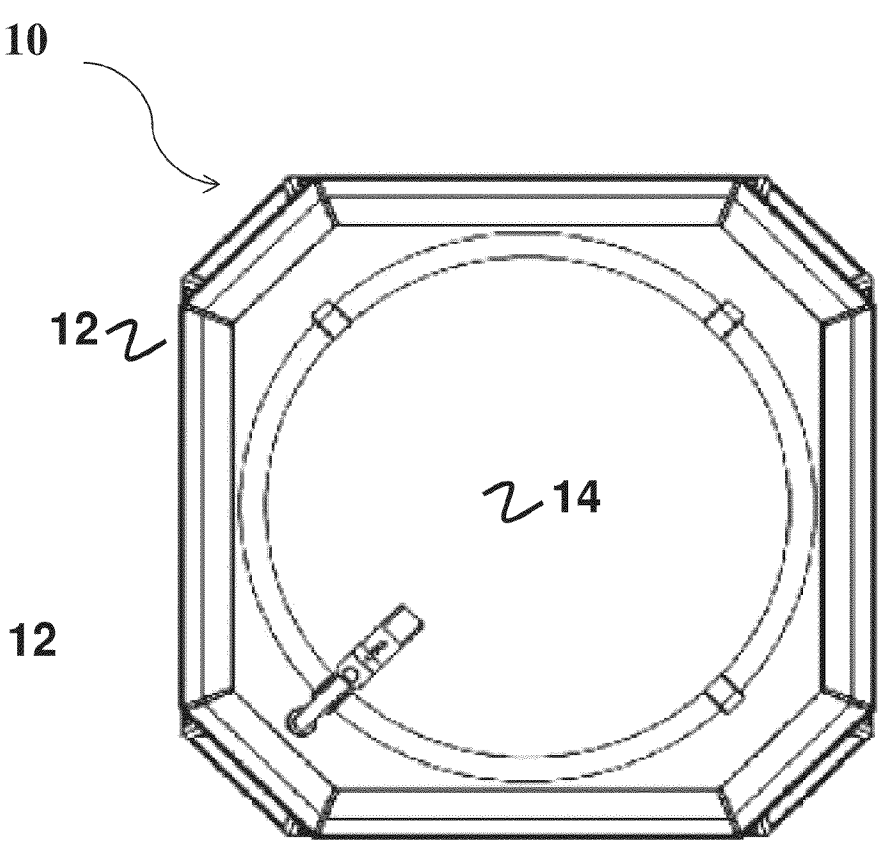
FIG. 1*b* is a top of the roulette system.

The exemplary embodiments herein relate to roulette systems, and particularly, a roulette system that includes a ball ejection mechanism and illumination system in order to generate an interactive roulette game with a predetermined outcome.

In some embodiments, the invention involves a roulette wheel mounted for rotational motion, having a plurality of slots defined by side walls and a bottom surface or landing, wherein an ejector element is positioned in the landing and configured for transverse motion from a planar position with the landing surface to a protruded position into the slot, whereby a ball in the slot is contacted by the ejector element and ejected from the slot when the ejector element is in the protruded position causing the ball to travel radially outward due to the contact with the ejector element and centrifugal motion of the spinning roulette wheel. The ejector element may be driven by a motor for driving the ejector element into the slot space defined by the side walls.

In some embodiments, the invention further includes sensors for detecting the location of the ball in the slot and a computing device for actuating the corresponding ejector element. In some embodiments, the ejectors are operated for a preset amount of time after the ball is introduced. In some embodiments, the ball may be introduced by hand or a propulsion device.

In some embodiments, the rotational motion of the wheel may be hand or mechanically driven by a driving mechanism.

In some embodiments, the ejector elements are used to maintain an outcome from being determined, that is, the ball from remaining in any one slot, for a period of time, such as in between game play. For example, the ejector elements may be used to attract play by keeping the ball moving within the roulette wheel device, if the roulette wheel is motorized, and then upon all wagers being placed, the game may be begin, such as by decreasing or increasing the rotational speed of the wheel, with the ejectors being disabled such that the ball may land and remain within one slot for purposes of determining a game outcome. Once the outcome is determined the game play may resume.

It should be readily apparent that the system may be employed with other wheel-based games that include a ball other than roulette.

In some embodiments, the invention involves a roulette wheel body mounted in a wheel body support device for rotational motion, which includes a plurality of illumination devices mounted on the wheel body or the support device. The illumination devices may be mounted circumferentially about the wheel and positioned to direct light radially inward such that each slot of the roulette wheel is illuminated.

In some embodiments, the invention further includes a computing device for controlling the illumination, to attract play or so that certain colors may be illuminated to indicate game play status, such as when wagers are permitted, or to indicate the winning outcome.

In some embodiments, the computing device may include a random number generator for determining the winning slot which is then displayed by the illumination devices. For example, the wheel may be illuminated by the illumination devices in a sequence about the circumference of the wheel that simulates rotational motion and then stop at the randomly determined location corresponding with a slot on the roulette wheel.

In some embodiments, one or more illumination devices may be mounted in the center of the rotating wheel and positioned to direct illumination radially outward.

It should be readily apparent that the system may be employed with other wheel-based games that include a ball other than roulette.

The invention may be combined with a live game that includes one or more remote kiosks or gaming stations. Each station is configured to receive and determine wagers based on one or more live games played at a nearby or remote location. The system is therefore configured to include devices which monitor the one or more live games, such as a roulette game presented within the current invention, in which a physical reel or other gaming elements are activated or employed, and collect the game play data from each of the games. In some embodiments, the game play data is manually entered for collection by the system. The game play data collected is transmitted to the terminals and used to determine the outcome of wagers placed at the terminals. The stations may be any apparatus or device capable of receiving and transmitting data, including devices which either process game play data or do not process game play data, including "thin-client" or "smart" devices. The stations present the live game information for each of the live games on a display device and further include a data input device for facilitating the entry of wagers. Thus, players interested in placing wagers on a live game are not confined to a single location or even the casino floor as the games continue.

It should be understood that each of the methods and individual steps recited herein may be partially or wholly carried out in a variety of ways and/or systems, which may include, but are not limited to, an electronic gaming machine (EGM) for use by one or more players, a multiplayer platform which may include a player interface such as a touchscreen display and involve physical or virtual game symbols, a home computer and/or portable computing device, such as a tablet computer or mobile phone capable of communicating with a network or over the Internet, global telecommunication network or world wide web.

It should further be understood that the invention is directed to, among other things, methods of providing, conducting and resolving wagering games that include a sequence of controlled and concrete transformative events. Some of these events may involve communications between computing components, indicating preferences, placing wagers, debiting and awarding credits stored in an account, the generation of random data and results for one or more players, the application of randomly-generated data to resolve wagers, the pooling of all wagers placed, the determination of wager outcomes in accordance with preset outcome determining criteria, and the notification of such outcomes along with the designation of a portion of the wager pool for each player and simulated roulette game outcome. The generation of random data may be facilitated by computerized and/or physical implements, such as a random number generator. The transformative events may also include parsing of the data for comparative purposes with preset criteria to determine an outcome in the underlying bingo game.

Selected exemplary embodiments of the invention will now be explained with reference to the drawings. It will be apparent to those skilled in the art from this disclosure that the following description of exemplary embodiments of the invention is provided for illustration only and not for the purpose of limiting the invention as defined by the appended claims and their equivalents.

Referring to the figures, where like numerals indicate like or corresponding parts throughout the several views, systems and methods of the invention which are configured to cooperate with another in order to provide a bingo game with a roulette feature are described.

System Generally

Figure 1A:
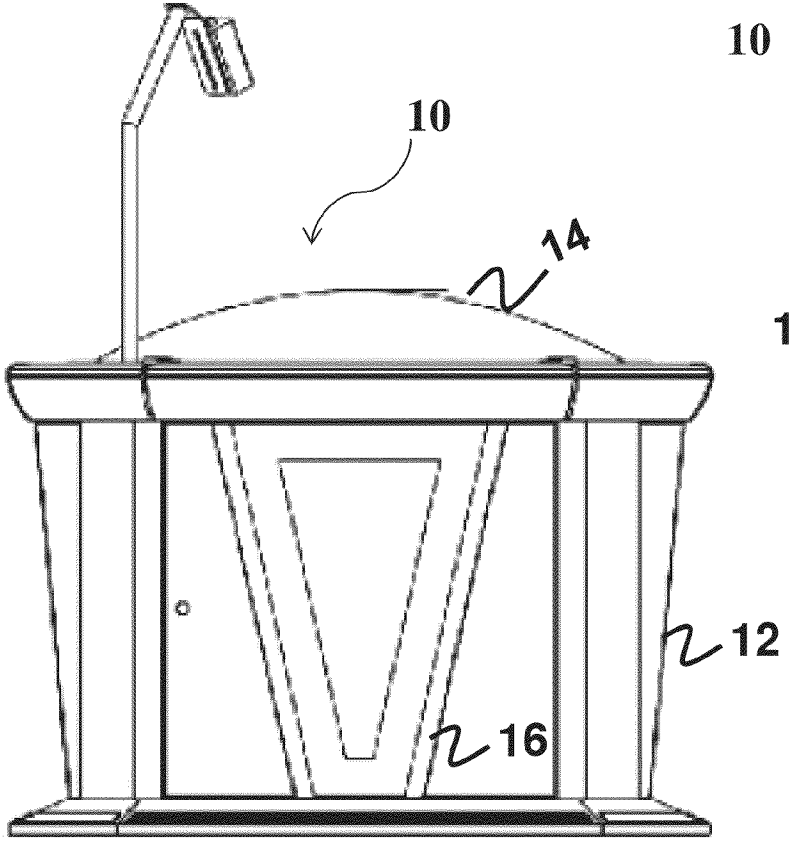
FIG. 1*a* is a side view of the roulette system including the present invention.

FIGS. 1*a* and 1*b* are side and top views of the roulette system 10, according to an embodiment of the present invention. The system 10 is housed in a cabinet 12 that incorporates all the elements necessary for the function of the system. Additional elements may be in communication with the system by way of access ports and wireless communication accessible through the cabinet 12. These methods of communication will be discussed in further detail below.

Each cabinet 12 includes a service door 16 in order to access the internal components of the system 10. Also, a dome enclosure 14 sits atop the cabinet 12 in order to allow user to view the internal components of the system 10. The dome enclosure also allows for the proper functionality of the air blowers 62 that are built into an embodiment of the present invention utilizing the ball ejection system (discussed in further detail below).

Figures 2A, 2B:
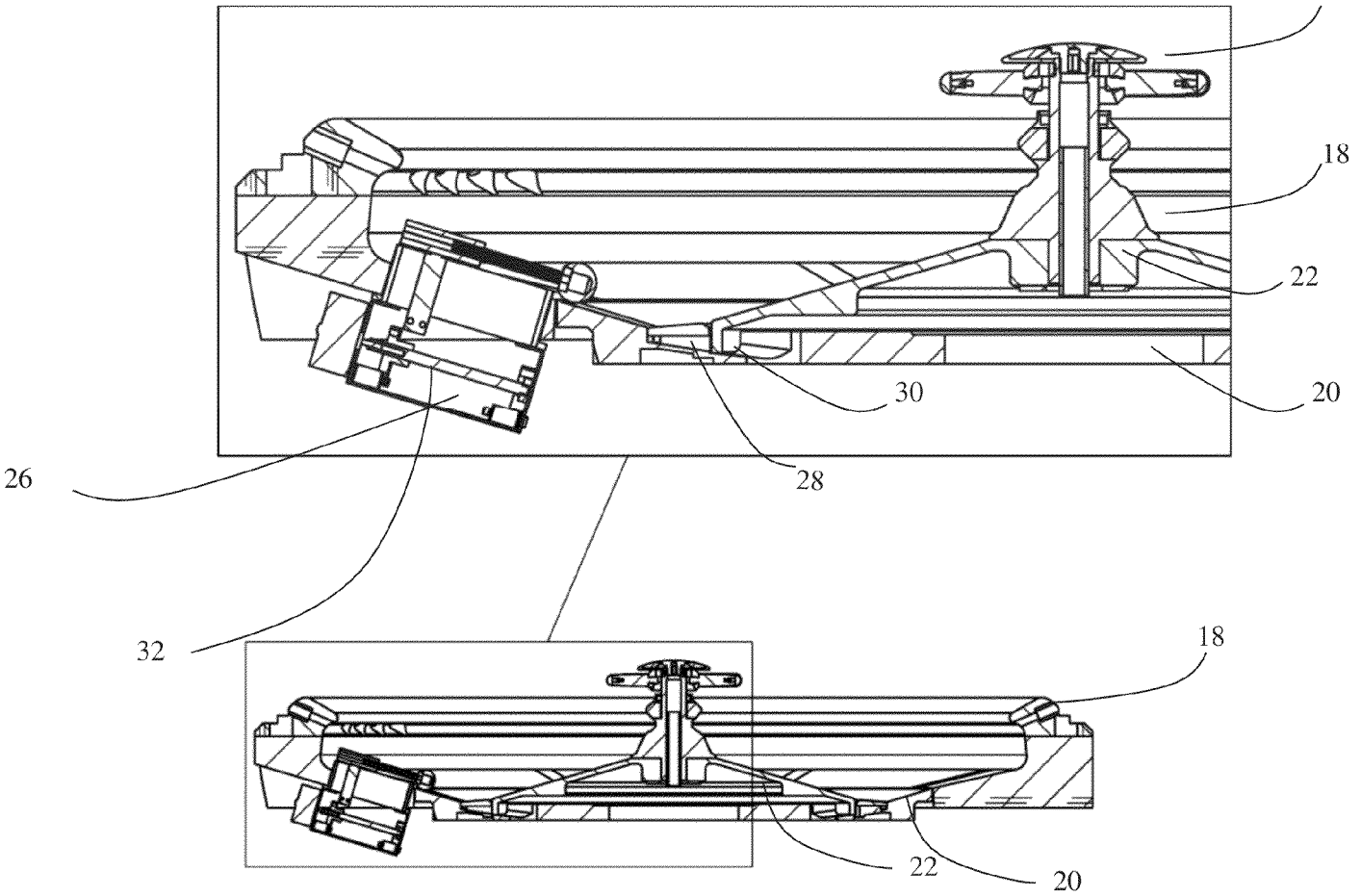
FIG. 2*a* is cross section of the internal roulette components.
FIG. 2*b* is a zoom-in of the cross section of the internal roulette components.

FIGS. 2*a* and 2*b* are illustrative drawings of a cross section of the internal components of the system 10. A user looking through the dome enclosure 14 will look and see a functioning interactive roulette table system functioning within the cabinet 12. Looking at FIG. 2*a* a user will see the primary visual component of the system 10 including the outer ring 18, the roulette wheel 20, the central cover 22, and the lighting pedestal 24.

The outer ring 18 is the component where a roulette ball will roll along until landing in the desired slot 28. The outer ring is designed to allow for the movement of the ball resulting from the force provided by the air blower 62 (discussed in further detail below). The outer ring 18 may be static or may also be configured for rotational movement dependent of the appropriate game mechanics that are desired. The outer ring may be made of a desired material (wood, metal, laminate, etc.) that is desired for the appropriate visual appeal and traction of the roulette ball for game play.

The roulette wheel 22 is fitted within the outer ring 18 and includes a plurality of slots 28. The roulette wheel 22 may include the numbers 1 through 36 defined by the plurality of slots 28. The roulette wheel 22 may be in the American, European, or another alternate format as described above. The numbers may be arranged sequentially or in a predetermined order depending on the desired form of game play. The colors utilized for each of the plurality of the slots 28 on the roulette wheel 20 may also be in a traditional alternating red/black pattern or may also be in any pattern necessary for game play. The roulette wheel 22 is configured to rotate around the center of the system 10 in order to allow for game play. The rotational motion may be manual or mechanical depending on the current embodiment utilized.

In some embodiments of the present invention, the system 10 also includes a central cover 22. The central cover 22 is fitted within the roulette wheel 20 and is configured to rotate about the center of the system 10 along with the roulette wheel 20. In another embodiment of the present invention, the central cover 22 is also configured to move vertically between a first and second. In the first position the central cover allows for a roulette ball to bounce within the top of the system 10 between the outer ring 18, the roulette wheel 20, and the central cover 22 until the roulette ball lands on the desired slot 28. When in the second position the central cover 22 is raised and allows the roulette ball to fall from a slot 28 into a chamber 30, away from the view of a user. The use of the first and second position for the central cover 22 is used in order to reset game play for the system 10. Further discussion on the chamber 30 will be address in conjunction with reset of a roulette game within the system 10 below.

The lighting pedestal 24 is located in the center of the system 10 below the dome enclosure 14. In some embodiments the pedestal 24 is configured to rotate independently from the roulette wheel 20 and the central cover 22. In some embodiments the lighting pedestal also includes additional components, such as an illumination system 66.

Below the roulette wheel there is an ejector mechanism 26. The ejector mechanism 26 includes an air blower 62 and worked in conjunction with additional components on the roulette wheel 20 in order to initiate the movement of a roulette ball along the outer ring 18 and into a desired slot 28. In some embodiments of the present invention the ejector mechanism is connected to the chamber 30 by way of a channel 32. At the conclusion of a roulette game a roulette ball could return to the ejector mechanism by way of the chamber 30 and the channel 32 in order to re-initiate game play.

Figure 2C:
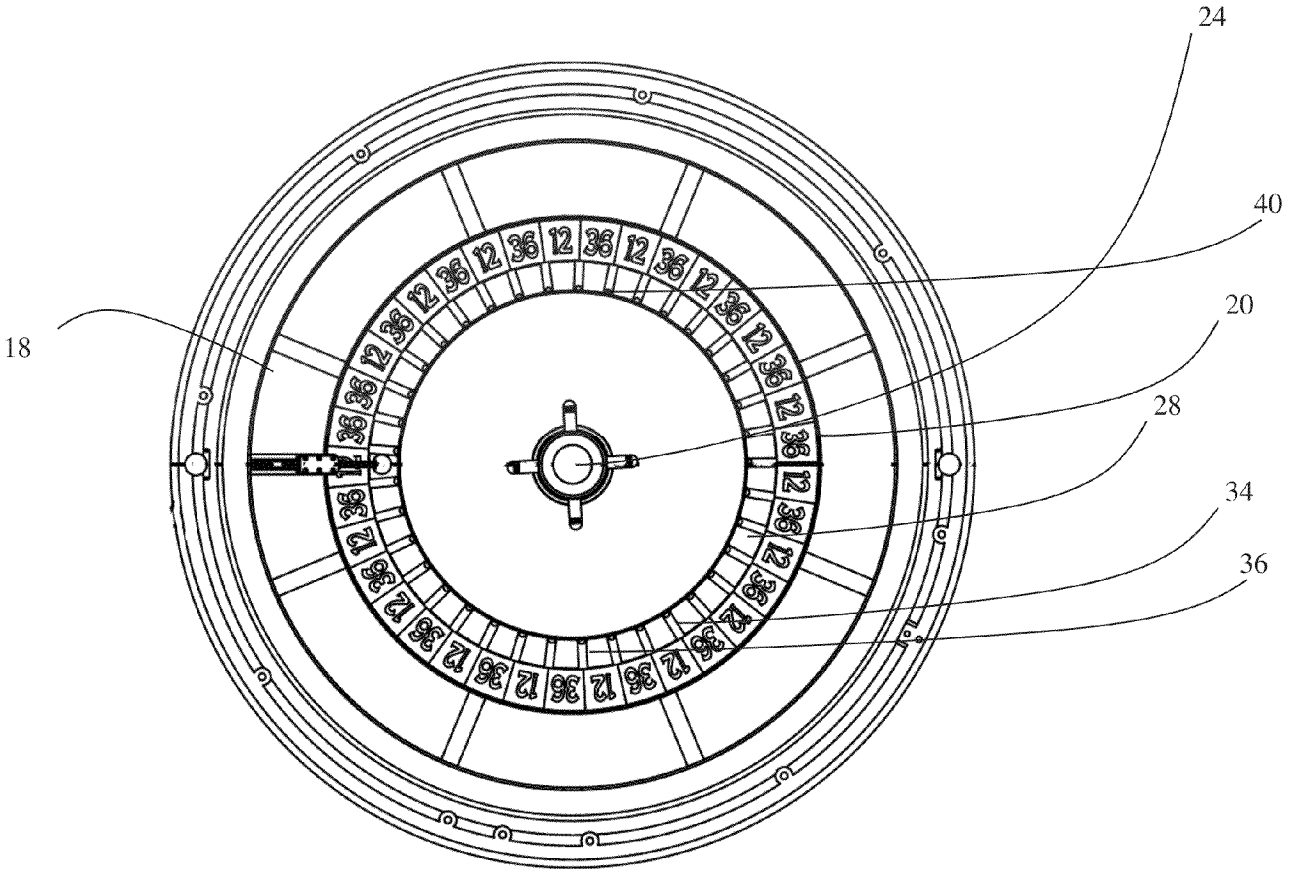
FIG. 2*c* is a top view of the internal roulette wheel components within the system.

FIG. 2*c* is a top view of the internal components of the system 10 viewed by a user during game play. In addition to the outer ring 18, the roulette wheel 20, and the central cover 22, the additional components of the roulette wheel 20 are also visible to the user from this top view of the system 10. The roulette wheel 20 is shown comprising a plurality of slots 28. Each slot 28 is defined by plurality of side walls 32 and a bottom surface 36. Each slot 28 also includes at least one opening 38 and a sensor 40. During a regular round of game play, the ejector mechanism 26 will eject a roulette ball onto the outer ring 18 during the simultaneous rotation of the roulette wheel 20.

The air blower 62 or other device will blow air circumferentially along the outer ring 18 in order to keep it moving during game play. Once a desired outcome is determined within the system 10 (discussed further below), the air blower 62 will reverse air flow and draw the roulette ball to the desired slot 28 by way of the opening 38. Alternatively another device will create a vacuum to draw a roulette ball to the desired slot 28. By reversing the air flow of the air blower 62 the system generates a vacuum and cause the roulette ball to gravitate towards the desired predetermined slot on the roulette wheel 20. The vacuum ends once the sensor within the slot 28 detects the roulette ball. Once the sensor 38 detects the roulette ball the game is concluded an appropriate outcome is determined. In some embodiments, the central cover will move from the first position to the second position after the ball is detected on the sensor 38. This allows the roulette ball to move into the chamber 30 and reset the system 10.

In some embodiments, the ejector mechanism further includes a hammer 41 (not shown). The hammer 41 is configured to have a first and second position, with the first position set just below the plurality of openings 38 of the roulette wheel 20 and the second position configured to traverse the opening 40. In some embodiments of the present invention a roulette wheel may not leave the top of the system 10 and is instead ejected from a slot 28 by the hammer 41 in order to initiate game play.

Figure 3:
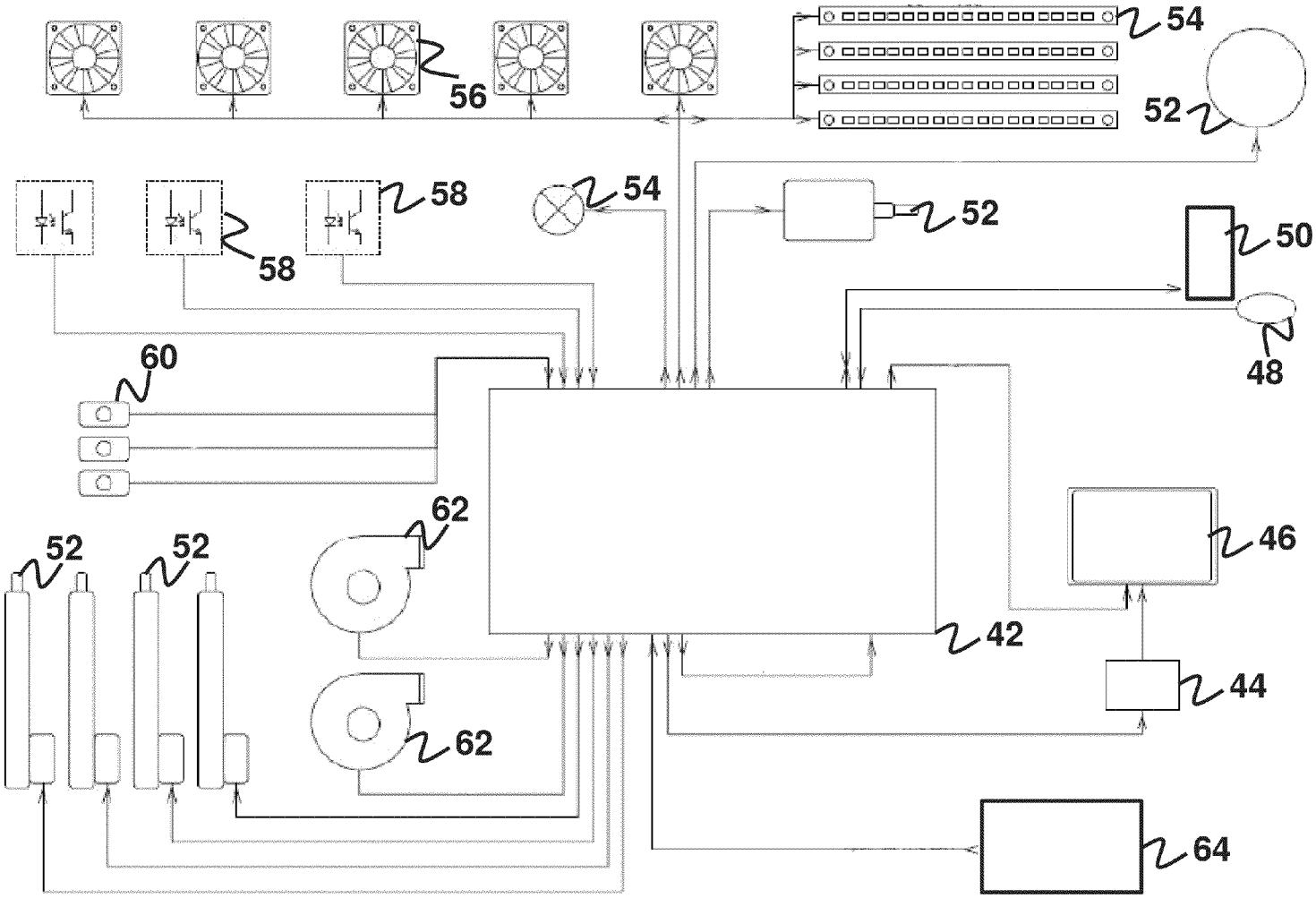
FIG. 3 is a schematic view of the internal components within the system.

FIG. 3 is a diagram of the internal schematic of the system 10. These components are utilized in conjunction with the additional elements of the system 10 in order to initiate and complete the rounds of game play on the roulette wheel 20. The first component presented within FIG. 3 is the controller 42, which coordinated all of the other components within the system 10 in order to initiate game play. The controller 42 may be within the cabinet 12 but may also reside as an external component as well.

The system 10 also includes a power supply 44, which provides electricity to all the components within the system 10. A display device 46 is utilize in order to run diagnostics and view any necessary information related to the function of the system 10. An alternate input device 48 may be used to manipulate the information presented on the display device 46 and initiate service instruction necessary for the initiation and service of the system 10. Examples of an alternate input device 48 may include any input device common with a general use personal computer including a keyboard, mouse, and/or a tactile input interface integrated into the display device 46.

A network interface device 50 connects the system 10 with other network devices in order to allow a user to interact with the system 10. The network interface device may allow for both wired and wireless connections depending on the needs of the network set up for game play. The integration of the system 10 within a networked environment will be discussed further below.

The system 10 also contains a plurality of driving mechanism 52. Each driving mechanism may be either a lifting (generating vertical movement) motor or a rotating motor and may be used to drive the individual components of the system 10.

A plurality of LED lights 54 is used by the system 10 in order to illuminate the various portions of the system 10 and drive the illumination system 66 of the invention. A plurality of fans 56 are used to maintain the temperature of the system during operation and game play.

A plurality of sensors receivers 58 coordinate with the plurality of sensors 40 on the roulette wheel 20 in order to initiate and coordinate game play on the roulette wheel 20. The plurality of switches 60 regulate access to the access areas of the system 10 (i.e. the service door 16 and the dome enclosure 14).

The air blowers 62 generate the required air flow needed for the movement of the roulette wheel during game play. Finally, an RNG 64 may be used by the system 10 in order to generate the game outcome that is then display on the roulette by way of the system 10.

Figure 4A:
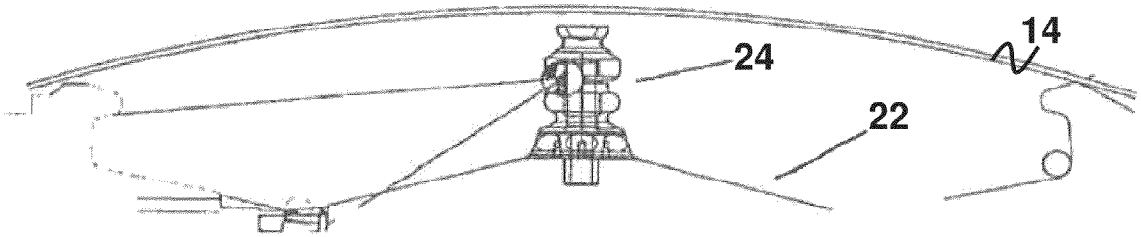
FIG. 4*a* is an additional cross-sectional view of the roulette feature within the system.
Figure 4B:
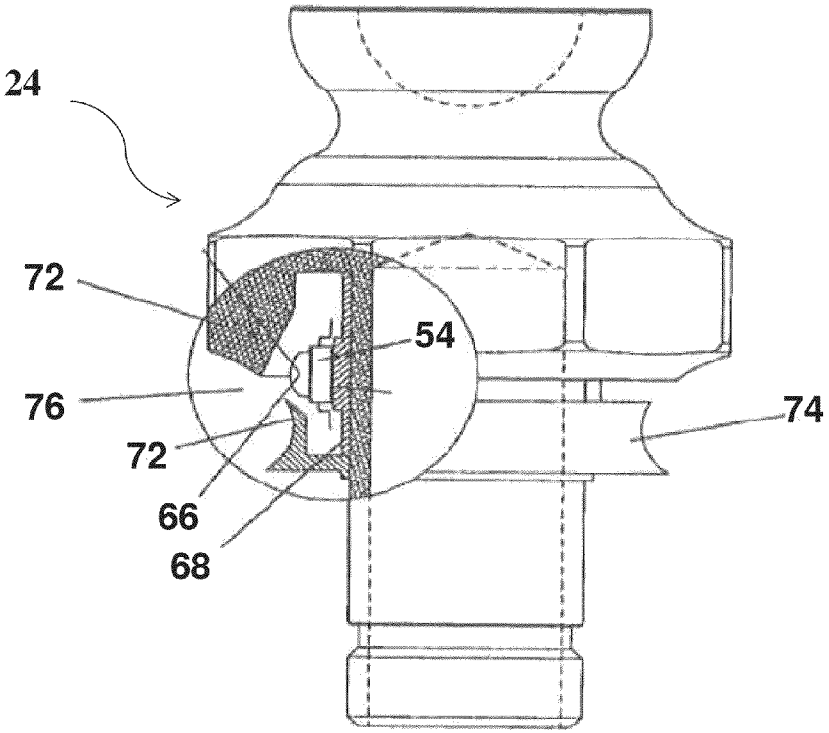
FIG. 4*b* is a zoom-in of the lighting pedestal including an embodiment of the present invention.

FIGS. 4*a* and 4*b* show an embodiment of the system 10 that includes an illumination system 66. The illumination system 66 may be used in order to initiate and generate game play and features related to game play through the use of the plurality of LEDs 54. FIG. 4*b* shows a zoom in of the lighting pedestal 24 that incorporates the illumination system 66. Attached to the lighting pedestal 24 is an LED holder 68, which is configured to hold a plurality of LEDs 54. The holder 68 and the lighting pedestal 24 are configured to order to generate a plurality of edges 72 that ensure that the LEDs 54 display light on the plurality of slots 24 on the roulette 20 through an opening 76.

The illumination system 66 allows for the use of the roulette system 10 to operate without a roulette wheel by illuminating it appropriate slot on the roulette wheel 20 during game play. The lighting pedestal 24 and the roulette wheel 20 may rotate independently in order to generate further excitement during game play. The illumination system 66 may also be used to indicate elements of the game, such as the start of a game, the conclusion of a game, etc. The illumination system 66 may also indicate a game outcome generated by the RNG 62 by illuminating the appropriate slot 28 during a game.

Figure 5:
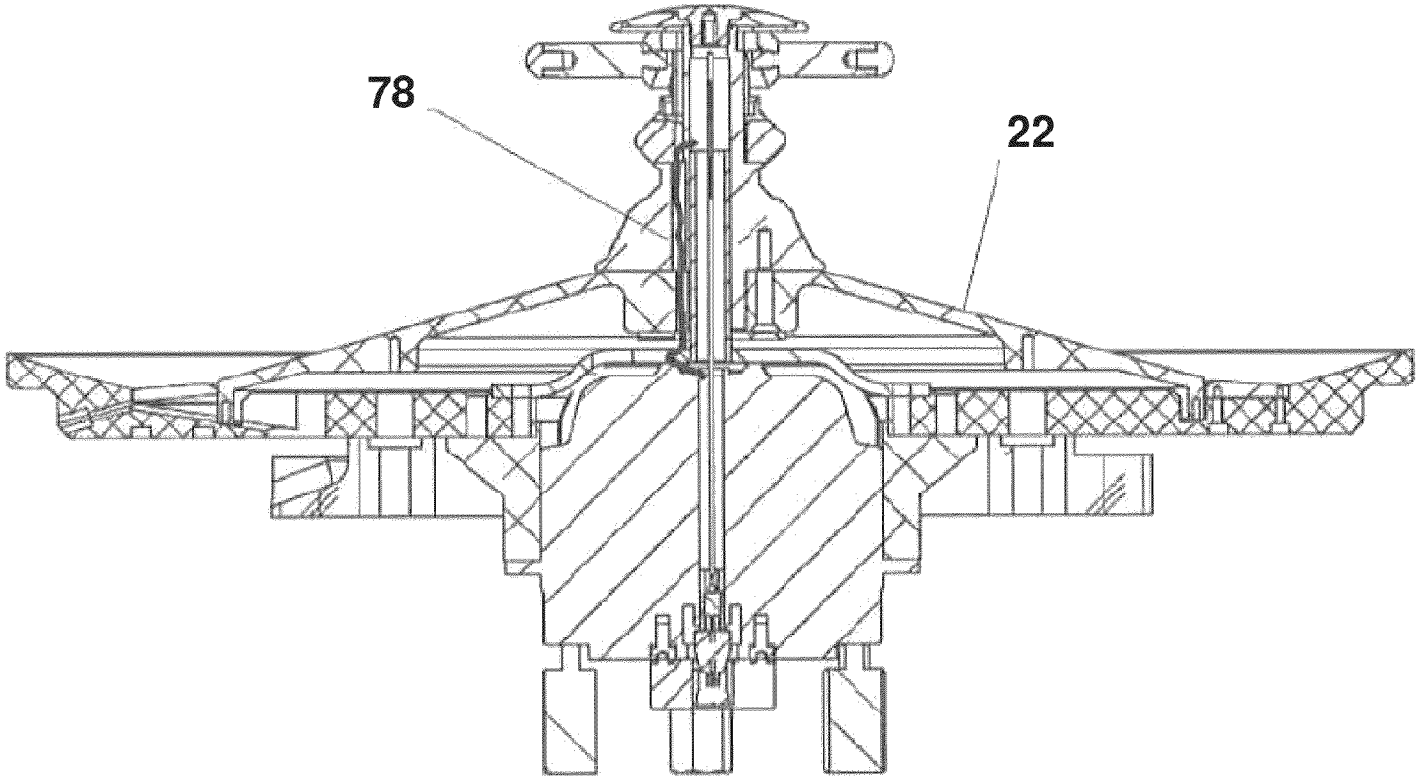
FIG. 5 is a cross-section of another embodiment of the roulette table components within the present invention.
Figure 6:
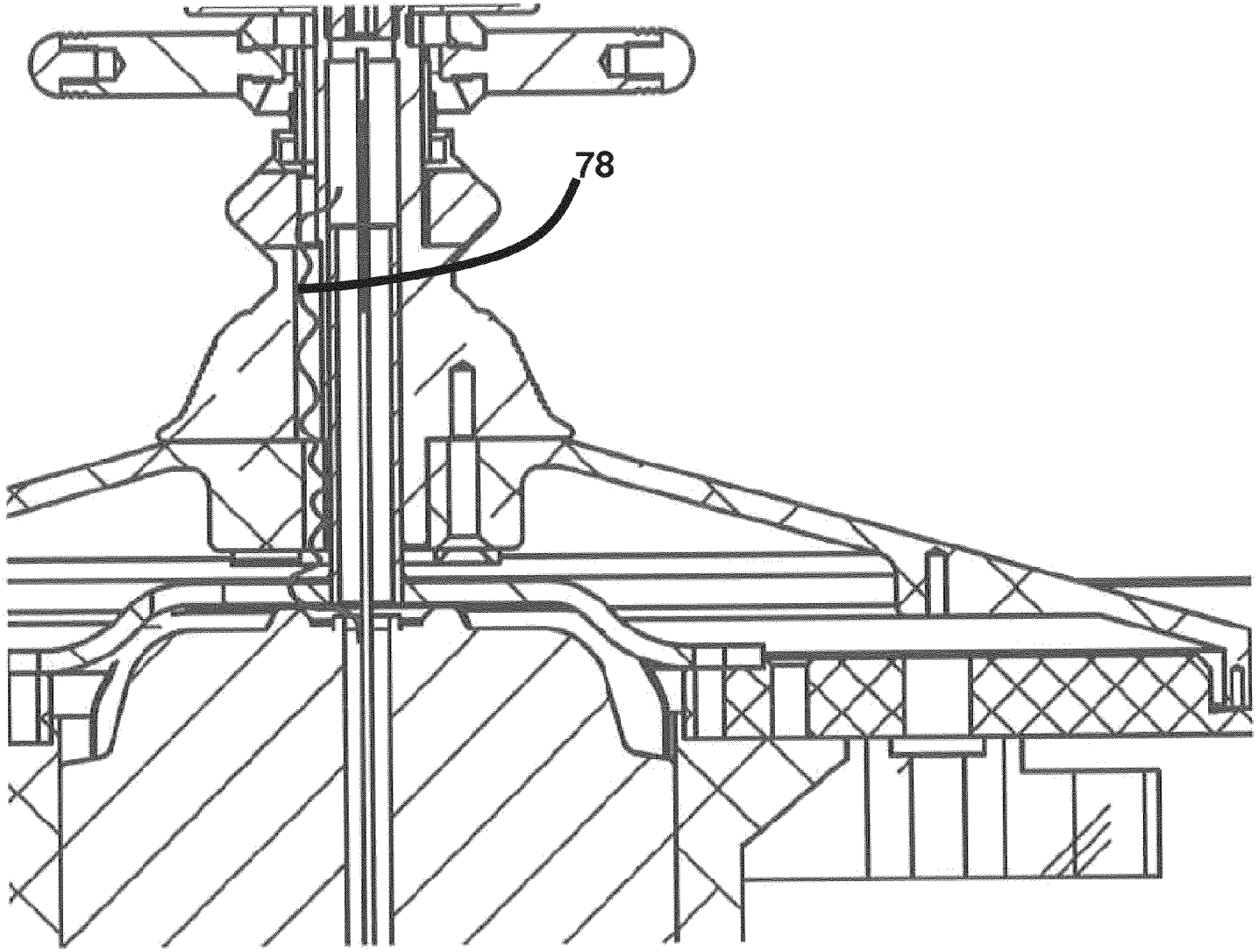
FIG. 6 is a zoom-in of the embodiment found in FIG. 5.

FIGS. 5 and 6 show another embodiment of the present invention wherein a cable 78 connects the illumination system 66 to the power supply 44. The cable 78 ensure that there a constant supply of power to the illumination system 66. This allows for the operation of the illumination system 66 when the central cover is also in the second position.

Networked System Generally

Figure 7:
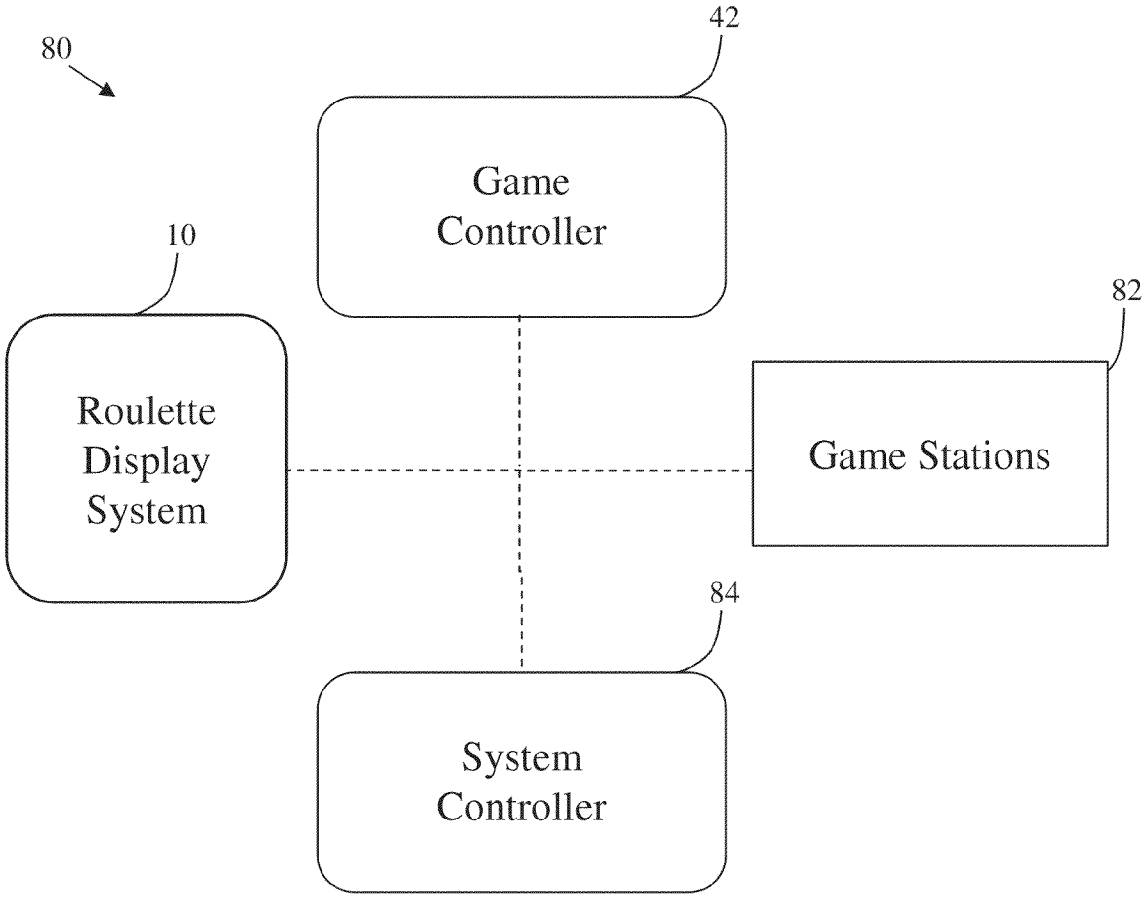
FIG. 7 is a diagram of a network system including an embodiment of the present invention.
Figure 8:
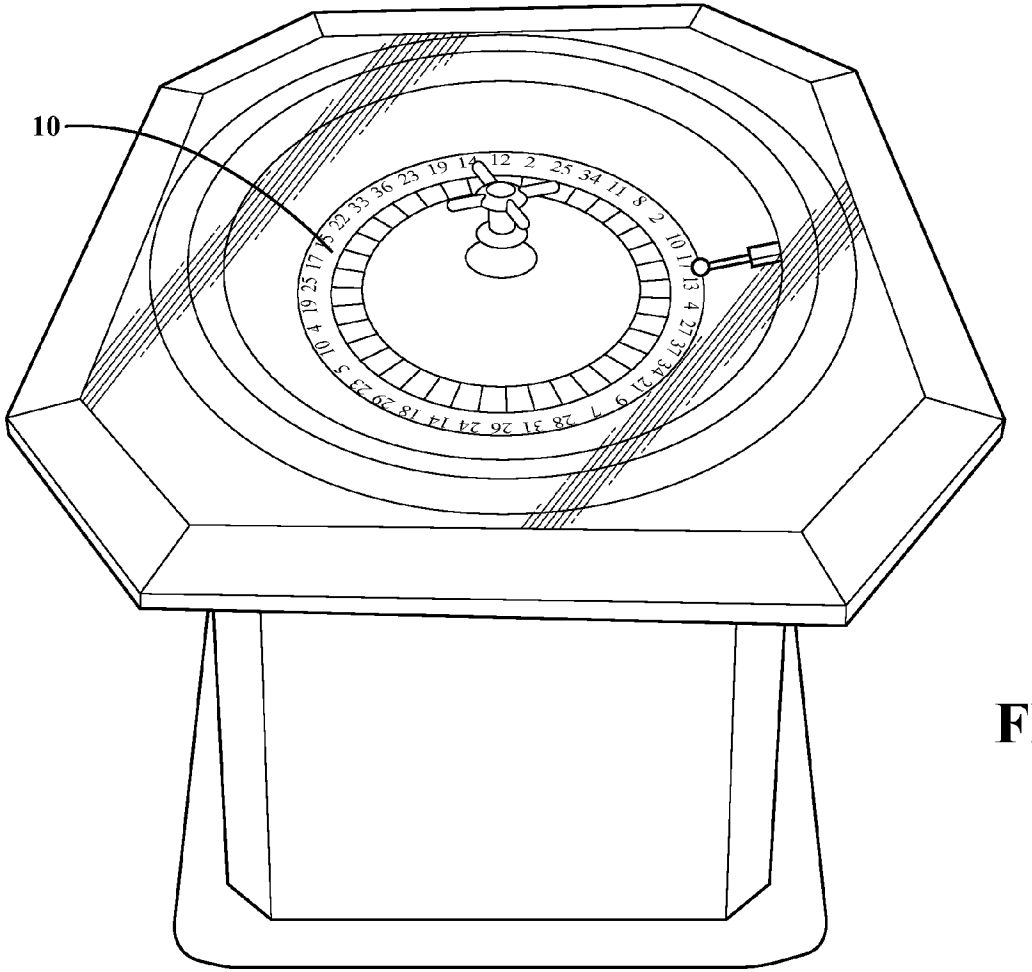
FIGS. 8 through 13 illustrate various embodiments of the invention.
Figure 9:
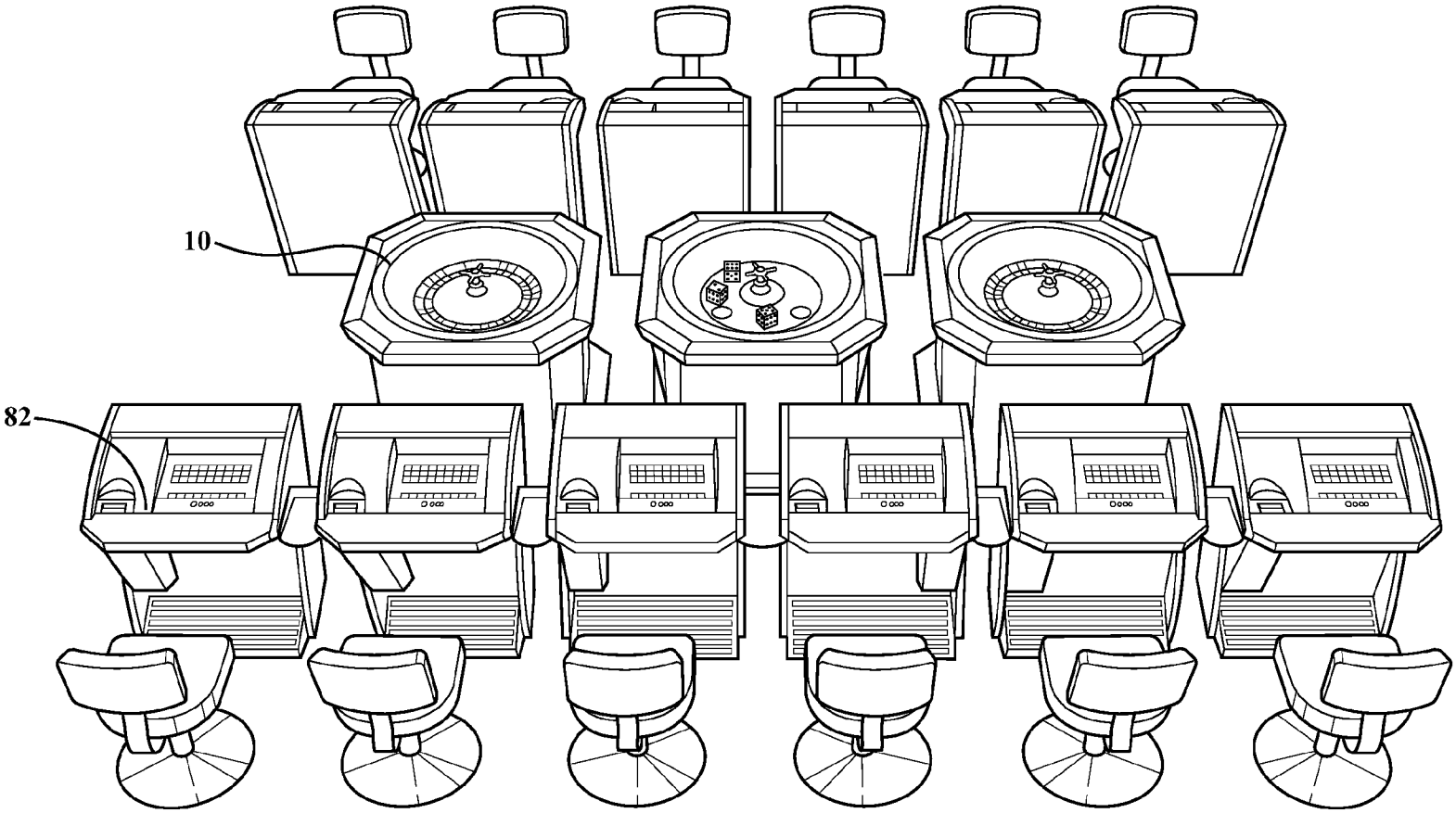
Figure 10:
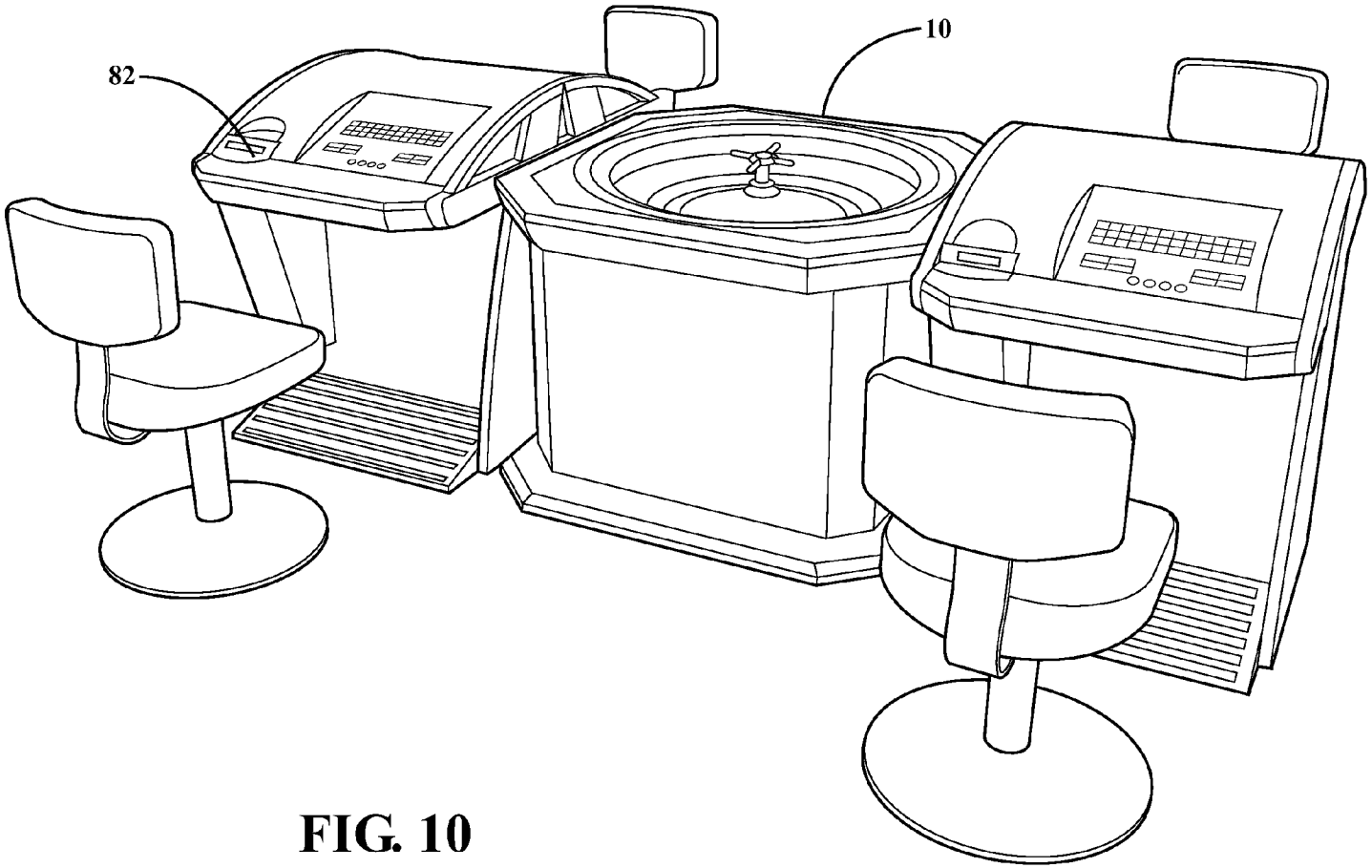
Figure 11:
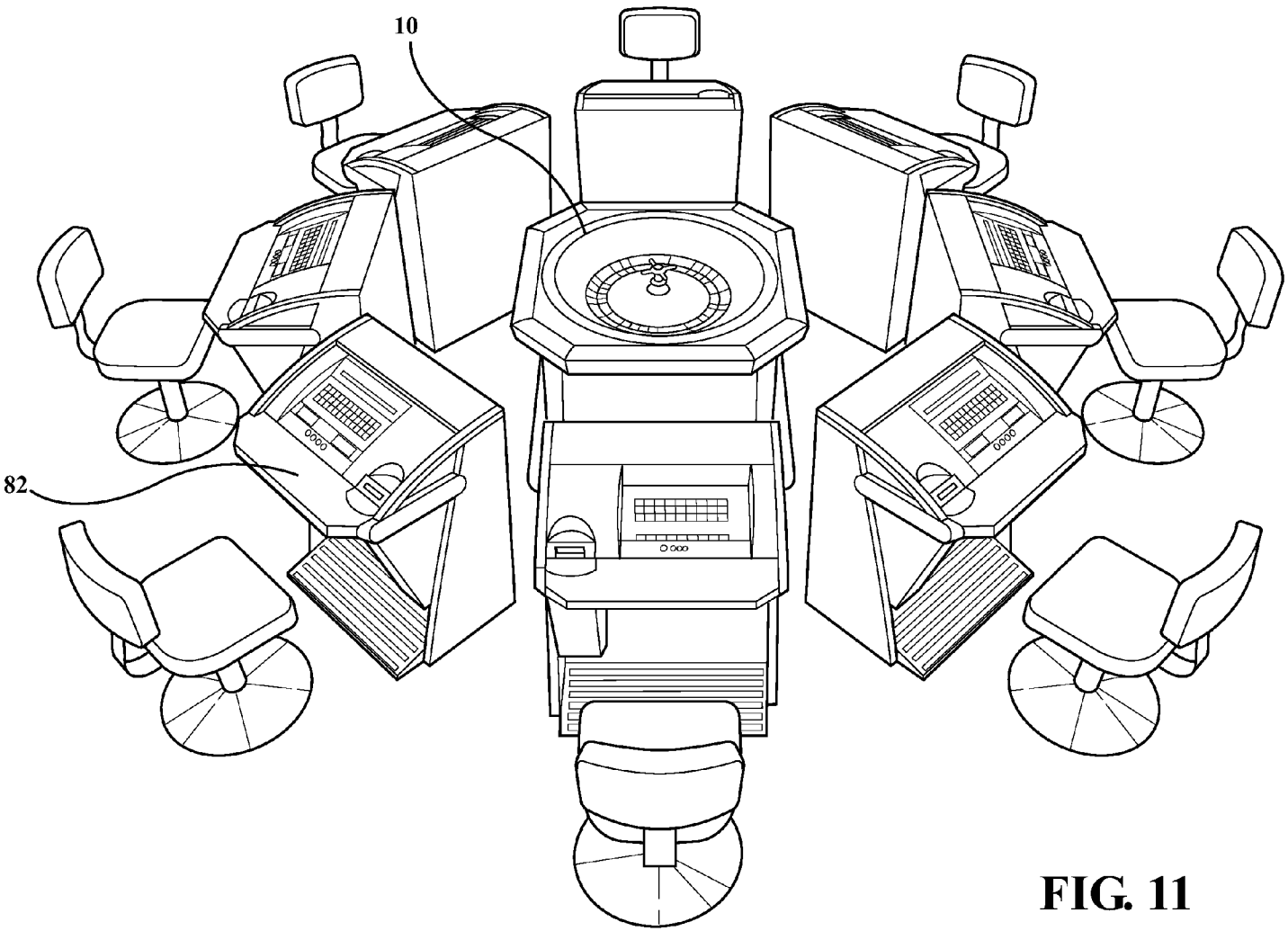

Referring to FIG. 7, a networked system 80 comprises one or more game stations 82, a controller 42, a system controller 84 and a system 10. These components may be housed in a unitary housing or remotely positioned with respect to each other, while remaining in communication. Communication between these components may be facilitated by data communication devices connected over a wired or wireless network, using any conventional digital communication devices that are appropriate based on the locations of the system components.

Each of the game stations 82 is used by the players in order to interact with the system and initiate game-play. Game stations 82 can take the form of player positions in a multi-player platform, electronic game machine cabinets or remote kiosks, but are not limited to such designs and may also be provided on smartphones, mobile computing devices, thin terminal devices, non-smartphone-type cellphones, tablets, laptops, or any other device configured to communicate within system 10. In some embodiments, game stations 82 include player input devices, such as keypads and display devices, or touchscreen displays, bill or ticket acceptors and printers, etc.

In some embodiments the system 10 incorporates a game station 12, a player input device, a communication device, and a controller. The game station includes a display device configured to display a user interface with a plurality of game options available for selection. Each game option is associated with a game play presentation, with at least one game options being a live bingo game. The player input device is in communication with the display device and receives selected game options, wherein game play presentations are displayed simultaneously on the display device responsive to the player selected game options. The communication device receives independent game data randomly generated for each of the selected game options. Finally, the controller processes the independent game data received by the communication device for each of the selected game options and facilitating independent game play presentations on the display device as a function of the independent game data.

The controller 42 may also include or is in communication with a display module, a random-number generator (RNG) module 62, a credit module, a betting module, a game module, and an award module, a bingo server, a processing device, a player input module, a communication device, and memory. The display module controls the display device on stations 82 to display various images on the graphical interfaces as discussed herein below, such as a roulette layout, preferably by using computer graphics and/or image data stored in the memory. The credit module communicates with a player account server to manage the amount of player's credits available for use in system 10 and converts currency or tickets received in stations 12 to credit. The game module includes a game program for use in providing gaming options in accordance with the invention. The game module may communicate with the bingo server to supply bingo cards or tickets to the stations 12 and communicate with the RNG module to obtain numbers from a pool of bingo numbers or balls. The betting module receives the player's wager information for resolving upon the conclusion of the game and the award module issues payouts for winning wagers. The player input device receives the player inputs in order to interact with the various gaming options and the gaming system 10 overall. The communication device maintains communication between the elements within the gaming system 10.

INDUSTRIAL APPLICATION

FIGS. 8 through 13 show multiple exemplary embodiments of the invention, including embodiments of game stations and live game features, which illustrate various industrial applications of the invention, among other things.

Figure 12:
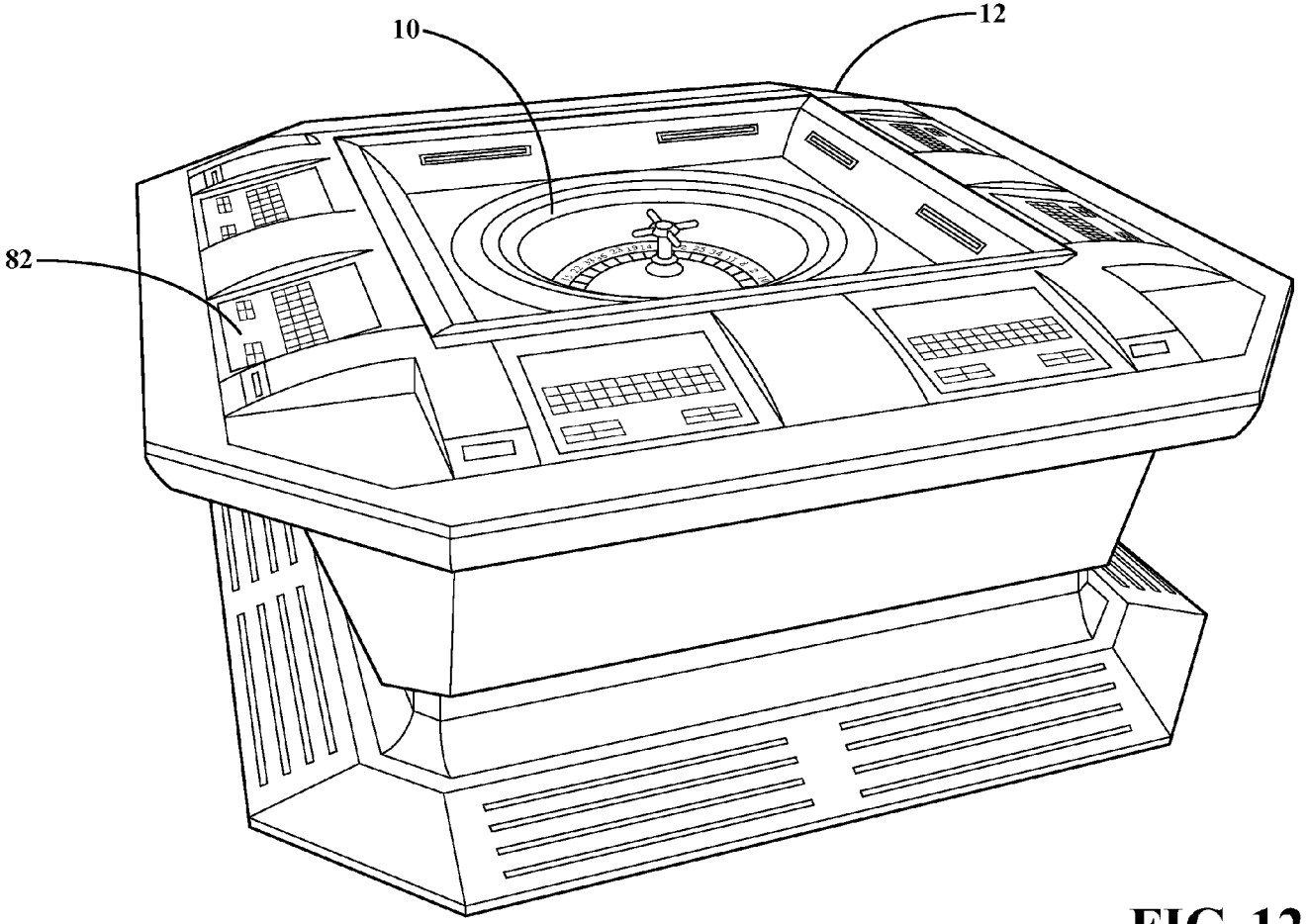
Figure 13:
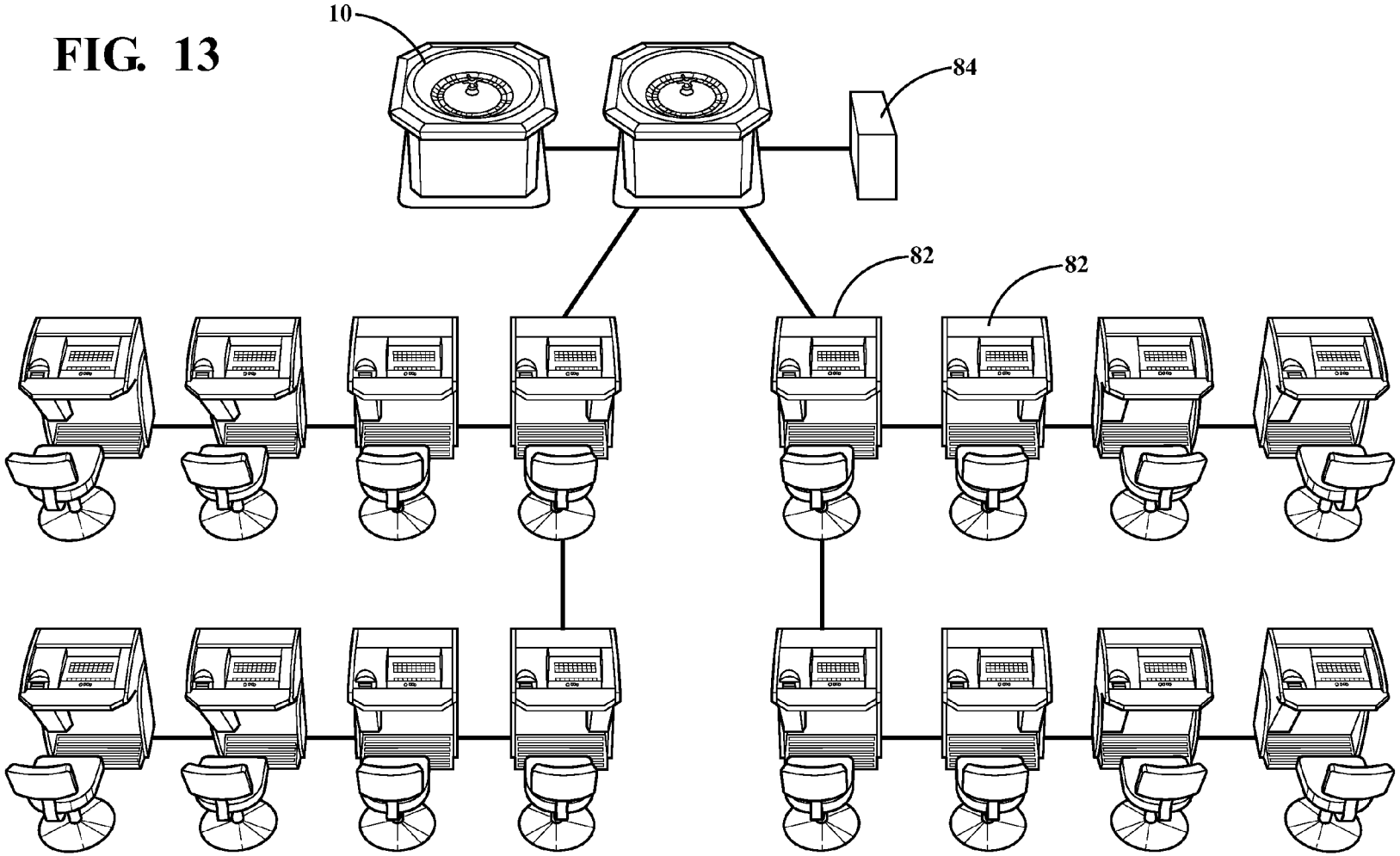

Particularly, FIG. 12 demonstrates an industrial application of the invention that integrates a system 10 with a game station 82 into one cabinet 12.

General Considerations

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. The terms used herein, such as modules like display module, betting module, award module, servers, etc., are for ease in describing and illustrating features and operations of the invention and are not to be considered limiting in any way. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the systems and methods described herein may be a standalone system or incorporated in an existing gaming system. The system of the invention may include various computer and network related software and hardware, such as programs, operating systems, memory storage devices, data input/output devices, data processors, servers with links to data communication systems, wireless or otherwise, and data transceiving terminals. It should also be understood that any method steps discussed herein, such as for example, steps involving the receiving or displaying of data, may further include or involve the transmission, receipt and processing of data through conventional hardware and/or software technology to effectuate the steps as described herein. Those skilled in the art will further appreciate that the precise types of software and hardware used are not vital to the full implementation of the methods of the invention so long as players and operators thereof are provided with useful access thereto, either through a mobile device, gaming platform, or other computing platform via a local network or global telecommunication network.

Although specific features of various embodiments of the invention may be shown in some drawings and not in others, this is for convenience only. In accordance with the principles of the invention, any feature of a drawing may be referenced and/or claimed in combination with any feature of any other drawing.

While exemplary systems and methods in accordance with the invention have been described herein and in the accompanying materials, it should also be understood that the foregoing along with the accompanying materials are illustrative of a few particular embodiments as well as principles of the invention, and that various modifications can be made by those skilled in the art without departing from the scope and spirit of the invention. Therefore, the described embodiments should not be considered as limiting of the invention in any way. Accordingly, the invention embraces alternatives, modifications and variations which fall within the spirit and scope of the invention as set forth in the claims, including equivalents thereto.

What is claimed is:

1. A ball ejection system for a roulette game comprising:

a roulette wheel mounted for rotational motion, the wheel including a plurality of slots, each slot defined by side walls and a bottom surface, each bottom surface further including an opening;

at least one sensor positioned within each of the plurality of slots, the at least one sensor configured to emit a signal when detecting a ball within the plurality of slots;

at least one ejector element positioned below the roulette wheel, the ejector element further including at least one air blower, the air blower configured to blow air circumferentially around the roulette wheel in response to the detection of a ball on one of the sensors; and a first driving mechanism in communication with the at least one ejector element, the first driving mechanism configured to cause the initiation of the at least one air blower; and further including a central cover, the central cover sized to the inner circumference of the plurality of slots and configured to move between a first position and a second position by lifting axially from the plurality of slots;

a third driving mechanism, the third driving mechanism configured to move the central cover between a first and second position in response to a signal; and a chamber below the roulette wheel, wherein the central cover provides access between the plurality of slots and the chamber within the first position and the second position.

2. The ball ejection system, as in claim 1, the system further including a second driving mechanism, the second driving mechanism in communication with the roulette wheel and configured to provide rotational motion to the roulette wheel.

3. The ball ejection system, as in claim 1, the system further including a controller connected to the plurality of sensors and the at least one ejector element, the controller configured to activate the first driving mechanism upon detection of a ball within the slot by at least one of the sensors.

4. The ball ejection system, as in claim 3, the controller further connected to the second driving mechanism, wherein the controller changes the rotational motion of the roulette wheel in response to a signal.

5. The ball ejection system, as in claim 3, the controller further connected third driving mechanism, wherein the controller initiates the movement of the central cover from the first position to the second position in response to a signal.

6. The ball ejection system, as in claim 3, wherein the controller changes the rotational motion of the roulette wheel in response to the presence of a ball within one of the plurality of slots.

7. The ball ejection system, as in claim 1, the system further including a dome enclosure over the roulette wheel.

8. The ball ejection system, as in claim 1, the system further including at least one hammer attached to the ejector element, the hammer having a first and second position, the hammer configured to reside below the roulette wheel when in the first position and axially traverses one hole in the plurality of slots when in the second position.

9. The ball ejection system, as in claim 1, the system further including at least one channel between the chamber and the at least one ejector element, the channel configured to allow for movement of a roulette ball between the chamber and the at least at least one ejector element.

10. The ball ejection system, as in claim 1, wherein the air blower is further configured to initiate a vacuum and cause the roulette ball to enter a predetermined slot on the roulette wheel, the controller further configured to deactivate the air blower upon the detection of the roulette ball by a sensor in at least one slot.

* * * * *